US009546790B2

(12) United States Patent
Cadima et al.

(10) Patent No.: US 9,546,790 B2
(45) Date of Patent: Jan. 17, 2017

(54) SYSTEM FOR GAS OVEN CONTROL

(71) Applicant: General Electric Company, Schenectady, NY (US)

(72) Inventors: Paul Bryan Cadima, Prospect, KY (US); John Mark Chilton, Campbellsburg, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 406 days.

(21) Appl. No.: 14/226,963

(22) Filed: Mar. 27, 2014

(65) Prior Publication Data

US 2015/0276229 A1 Oct. 1, 2015

(51) Int. Cl.
*F24C 3/00* (2006.01)
*F24C 3/12* (2006.01)

(52) U.S. Cl.
CPC ..... *F24C 3/128* (2013.01)

(58) Field of Classification Search
CPC ..... F24C 3/128
USPC ..... 126/21 R, 39 G; 236/15 A
See application file for complete search history.

(56) References Cited

U.S. PATENT DOCUMENTS 2,395,384 A * 2/1946 Ziebolz ..... F23N 1/02 137/114
3,469,780 A * 9/1969 Woock ..... G05D 23/1919 236/1 A
3,504,660 A * 4/1970 McArthur, Jr. ..... F24C 3/128 126/21 R
2007/0278319 A1 12/2007 Jenkins et al.
2010/0140520 A1 6/2010 Millius

* cited by examiner

*Primary Examiner* — Avinash Savani
(74) *Attorney, Agent, or Firm* — Dority & Manning, P.A.

(57) ABSTRACT

An improved system for control of a gas oven appliance is provided. A valve provides for control of the flow of gas to the burner. After preheating the oven, the valve is cycled between high and low (or zero) gas flow rates at frequency that provides the overall desired heating rate of the cooking chamber during cooking operations. A variety of valve types may be used including proportional types and predetermined set point types (e.g., high-low, high-medium-low, or on-off). During cooking operations, between periods of cycling, the valve is at least partially closed (e.g., set to a lower gas flow rate or an off state).

20 Claims, 6 Drawing Sheets

SYSTEM FOR GAS OVEN CONTROL

FIELD OF THE INVENTION

The subject matter of the present disclosure relates generally to a system for gas oven control.

BACKGROUND OF THE INVENTION

Gas ovens typically control temperature in the cooking chamber of the oven by using a valve to control the rate of gas flow to a gas burner that provides heat energy into the cooking chamber through combustion of the gaseous fuel. Upon starting a gas oven, the cooking chamber is preheated based on the desired set point temperature and, once obtained, the valve is manipulated in an effort to regulate the temperature around the desired set point. More specifically, typically the valve is cycled between completely on and completely off states in an effort to maintain an average temperature at or around the desired set point temperature.

Gas oven appliances used for baking can suffer disadvantages in heat control and distribution compared with oven appliances that use electric heating elements (e.g., resistance based heating elements). One important shortcoming of certain gas ovens can be the very high rate at which heating occurs. While a high heating rate is advantageous in terms of reducing the time for preheating the cooking chamber to the desired temperature, during cooking operations the high heat rate used to maintain the set-point temperature is too fast for certain food loads that cook better at lower heat rates (such as e.g., sugar cookies, cakes, pastries, dough).

Additionally, because of the large flue needed to enable good combustion of the gaseous fuel, a gas oven cools down rapidly when the gas burner is in the off state. This characteristic increases the amount of time during cooking operations such as baking that the burner must be fired (a short cycling period), which also increases the amount of time the food is exposed to a heating rate that is excessive.

FIG. 1 illustrates a plot of the temperature (measured at the oven center—i.e. the center oven temperature or "COT") versus time for a typical electric oven placed at a set point temperature of 350° F. FIG. 2 illustrates a plot of COT versus time for a typical gas oven placed at a set point temperature of 350° F. As stated, the gas oven operates with higher heating and cooling rates and must also cycle on and off more frequently as compared to the electric oven to maintain similar amplitudes. More specifically, in FIG. 1, the period of the typical electric oven temperature plot is about 6 to 8 minutes, the heating rate is about 8° F. per minute, and the cooling rate is about 4° F. per minute. For FIG. 2, the period of the gas oven temperature plot is about 1 to 2 minutes, the heating rate is about 29° F. per minute, and the cooling rate is about 15° F. per minute.

FIG. 3 sets forth an additional problem that occurs in conventional gas oven operation. Temperature measurements of the oven chamber (COT) are shown over time with a door opening event (DO) shown at approximately 27 minutes. After preheating and then entering a cycling state around the temperature set point, a transient response occurs when the oven door is opened and food is introduced into the cooking chamber. The gas oven drops in temperature as heat escapes due to opening of the door and the addition of a relatively cold food load. As such, the gas oven effectively reverts back to a preheat mode where the gas burner runs on high and then reinitiates cycling around the desired temperature set point temperature. Again, this relatively high rate of heating exceeds the rate that results in optimum baking performance of certain foods. The problem is particularly exacerbated for short cooking cycle foods that bake in only about e.g., 10 minutes. The rapid reheat phase can affect as much as 50% of the baking period. Efforts to offset these responses by adjusting the calibration point of the ovens does not effectively correct the outcome and negatively impacts the cooking times of long cycle foods such as casseroles, meats, etc.

A final issue with certain conventional gas ovens is the tendency for the heat entering the oven to do so in a single flow pattern (a developed flow field). This means the heat circulates through the oven in a similar flow pattern for the bulk of the heating time because the heat source is constant. As a result, heating within the oven and heating of the food loads in particular is not performed uniformly. It is inherent that some portions of the foods will be heated more or less than others with the constant supply of convective heat.

Accordingly, an improved system for gas oven control would be useful. Such an improved system that can also provide more uniform heating of the cooking chamber and foods placed therein would also be useful.

BRIEF DESCRIPTION OF THE INVENTION

The present invention provides an improved system for control of a gas oven appliance. A valve provides for control of the flow of gas to the burner. After preheating the oven, the valve is cycled between high and low (or zero) gas flow rates at frequency that provides the overall desired heating rate of the cooking chamber during cooking operations. A variety of valve types may be used including proportional types and predetermined set point types (e.g., high-low, high-medium-low, or on-off). During cooking operations, between periods of cycling, the valve is at least partially closed (e.g., set to a lower gas flow rate or an off state). Additional aspects and advantages of the invention will be set forth in part in the following description, or may be apparent from the description, or may be learned through practice of the invention.

In one exemplary aspect, the present invention provides a method of operating a gas oven appliance having a cooking chamber. The gas oven appliance has a maximum rate of heating, $H_{MAX}$. The method includes the steps of opening a valve to preheat the cooking chamber at the maximum rate of heating, $H_{MAX}$, until at least a temperature T1 is obtained in the cooking chamber; closing the valve at least partially to provide a rate of heating, $H_{COOL}$, of the cooking chamber that is less than the maximum rate of heating, $H_{MAX}$, until the temperature in the cooking chamber decreases to at least a temperature T2 that is less than temperature T1; cycling the valve between a higher gas flow rate setting and a lower gas flow rate setting so as to heat the cooking chamber at a rate of heating $H_{CK}$ that is less than the maximum rate of heating $H_{MAX}$, the step of cycling continuing until the temperature of the cooking chamber increases to at least a temperature T3 that is greater than temperature T2; and shutting the valve at least partially to provide a lower rate of heating that is less than $H_{MAX}$ while the cooking chamber decreases to at least the temperature T2.

In another exemplary aspect, the present invention provides an oven appliance having a cooking chamber for the receipt of food for cooking; a gas burner for combustion of a gaseous fuel to heat the cooking chamber; a valve controlling a flow of gaseous fuel to the gas burner; a temperature sensor for measuring the temperature of the cooking chamber; and a controller in communication with the valve and the temperature sensor. The controller is configured for opening the valve to preheat the cooking chamber at a maximum rate of heating, $H_{MAX}$, at least until a temperature T1 is obtained in the cooking chamber; closing the valve at least partially to provide a rate of heating, $H_{COOL}$, of the cooking chamber that is less than the maximum rate of heating, $H_{MAX}$, the valve remaining at least partially closed until the temperature in the cooking chamber decreases to a temperature T2 that is less than temperature T1; cycling the valve between a higher gas flow rate setting and a lower gas flow rate setting so as to heat the cooking chamber at a rate of heating $H_{CK}$ that is less than the maximum rate of heating $H_{MAX}$, continuing the step of cycling until the temperature of the cooking chamber increases to at least a temperature T3 that is greater than temperature T2; shutting the valve at least partially to provide a lower rate of heating that is less than $H_{MAX}$ while the cooking chamber decreases to at least the temperature T2; and repeating the steps of cycling, continuing, and shutting for a period of time sufficient for cooking.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION OF THE INVENTION

Figure 1:
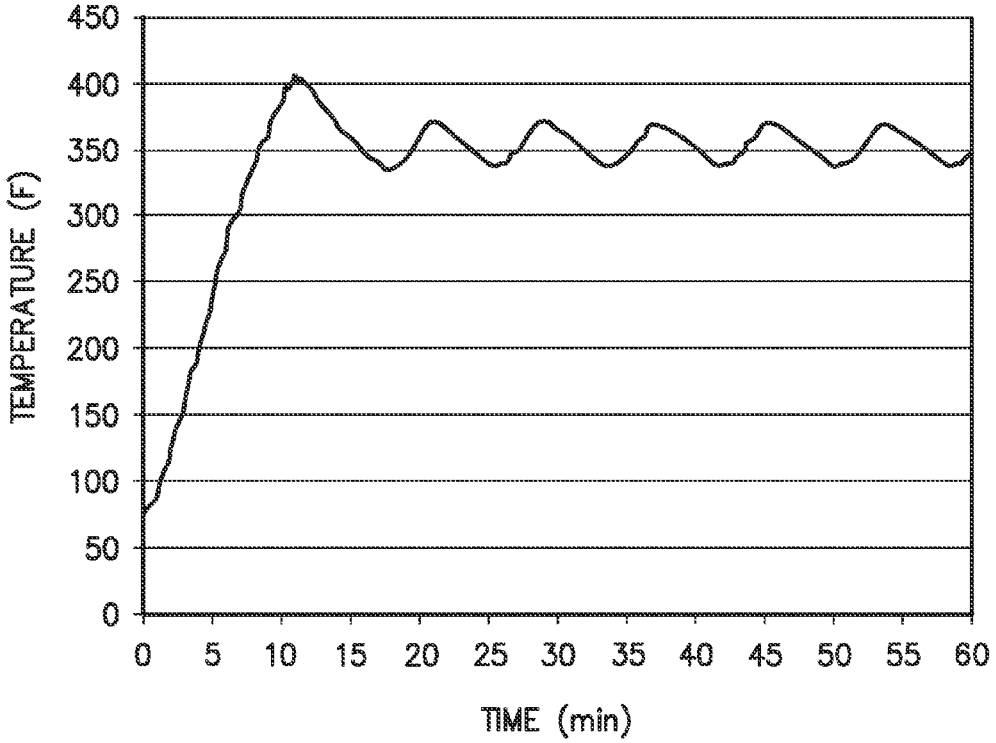
FIG. 1 is a plot of temperature over time for the operation of a conventional electric oven including the time for preheating.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 4:
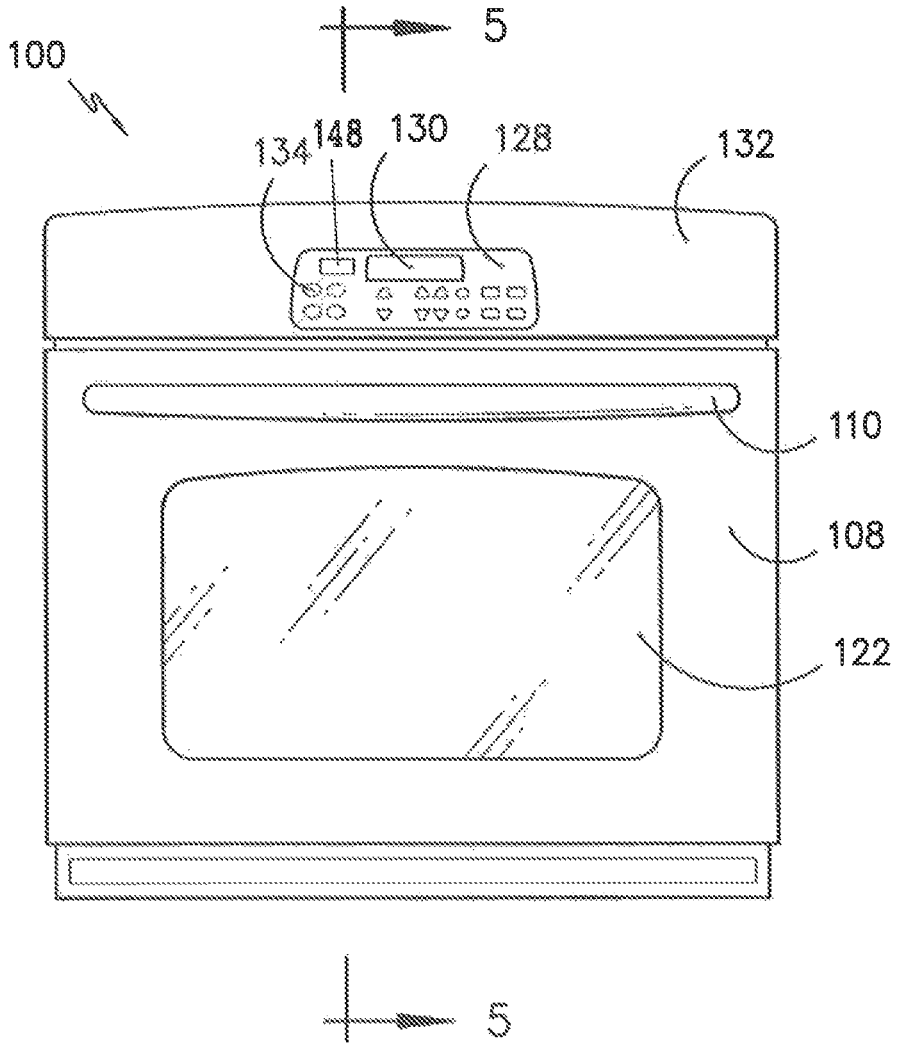
FIG. 4 is a front view of an exemplary gas oven of the present invention.
Figure 5:
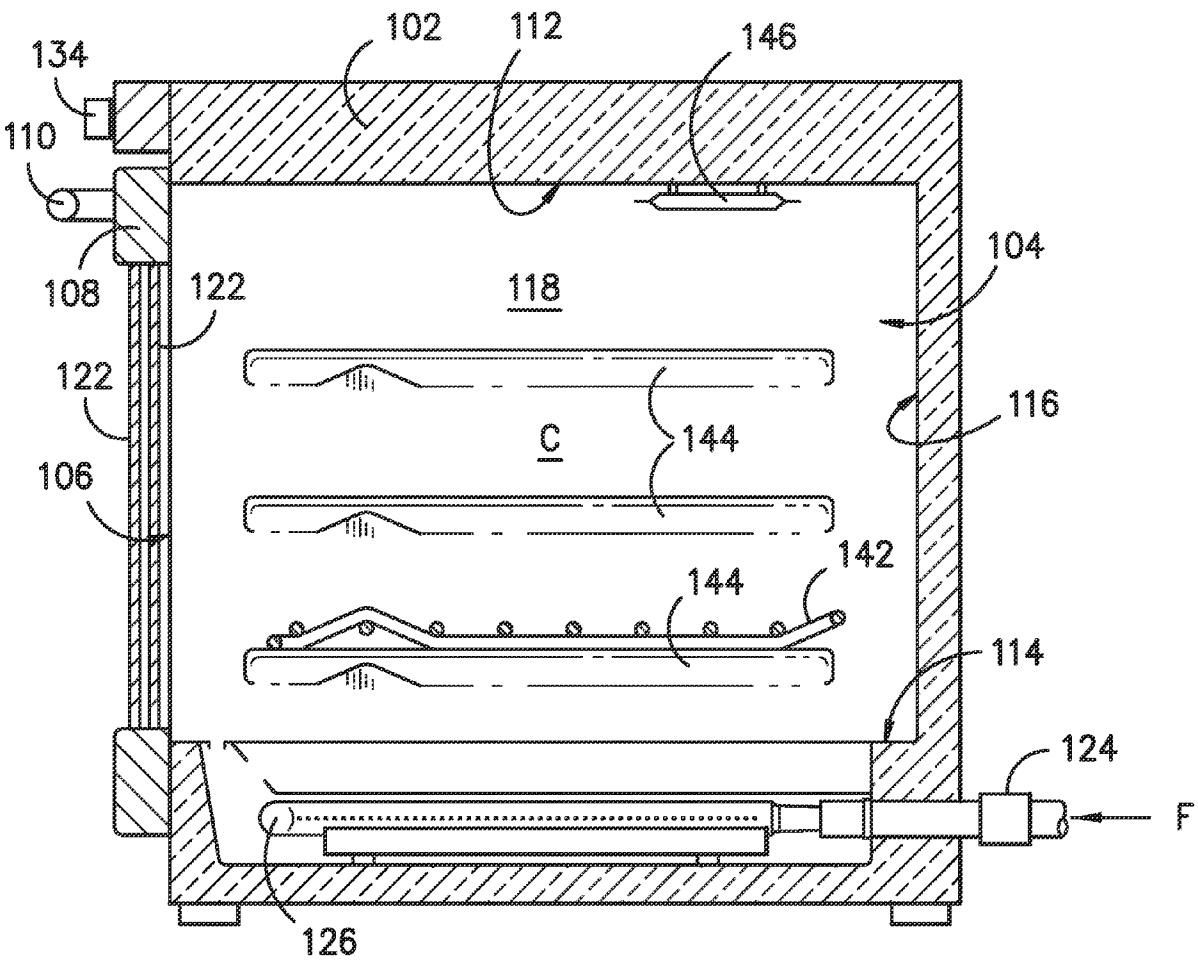
FIG. 5 is a side, cross-sectional view of an exemplary gas oven of the present invention.

Referring to FIGS. 4 and 5, for this exemplary embodiment, oven appliance 100 includes an insulated cabinet 102 with an interior cooking chamber 104 defined by a top wall 112, a bottom wall 114, a back wall 116, and opposing side walls 118, 120. Cooking chamber 104 is configured for the receipt of one or more food items to be cooked. Oven appliance 100 includes a door 108 rotatably mounted, e.g., with one or more hinges (not shown), to cabinet 102 at the opening 106 of cabinet 102 to permit selective access to cooking chamber 104 through opening 106. A handle 110 is mounted to door 108 and assists a user with opening and closing door 108. For example, a user can pull on handle 110 to open or close door 108 and access cooking chamber 104.

Oven appliance 100 can include a seal (not shown) between door 108 and cabinet 102 that assists with maintaining heat and cooking fumes within cooking chamber 104 when door 108 is closed as shown in FIGS. 4 and 5. Multiple parallel glass panes 122 provide for viewing the contents of cooking chamber 104 when door 108 is closed and assist with insulating cooking chamber 104. A baking rack 142 is positioned in cooking chamber 104 for the receipt of food items or utensils containing food items. Baking rack 142 is slidably received onto embossed ribs or sliding rails 144 such that rack 142 may be conveniently moved into and out of cooking chamber 104 when door 108 is open.

A gas burner 126 is shown at the bottom of cooking chamber 104 and provides heat to cooking chamber 104 for cooking. Oven appliance 100 may be equipped with burners at other locations within oven 100 as well such. For example, a burner may be located along top wall 112 only, or along both top wall 112 and bottom wall 114. For the exemplary embodiment shown, bottom burner 126 is a U-shaped gas burner positioned adjacent to and below bottom wall 114. Other configurations with or without wall 114 may be used as well.

Oven appliance 100 includes a user interface 128 having a display 130 positioned on an interface panel 132 and having a variety of controls 134. Interface 128 allows the user to select various options for the operation of oven 100 including, e.g., temperature, time, and/or various cooking and cleaning cycles. Operation of oven appliance 100 can be regulated by a controller 148 that is operatively coupled, i.e., in communication with, user interface 128, valve 124, temperature sensor 146, and/or other components of oven 100 as will be further described.

For example, in response to user manipulation of the user interface 128, controller 148 can operate valve 124 to control the flow of gas to burner 126 and thereby control the rate of heating H of cooking chamber 104. Controller 148 can receive measurements from a temperature sensor 146 placed in cooking chamber 104 and, e.g., provide a temperature indication to the user with display 130. Controller 148 can also be configured to operate oven 100 according to various exemplary aspects of the invention as will be further described herein. Temperature sensor 146 can be placed near top wall 112 (as shown), bottom wall 114, or near the center C of cooking chamber 104 to provide COT measurements. Alternatively, multiple temperature sensors may be used to provide temperature measurements to controller 148.

By way of example, controller 148 may include a memory and one or more processing devices such as microprocessors, CPUs, or the like, such as general or special purpose microprocessors operable to execute programming instructions or micro-control code associated with operation of oven appliance 100. The memory may represent random access memory such as DRAM or read only memory such as ROM or FLASH. In one embodiment, the processor executes programming instructions stored in memory. The memory may be a separate component from the processor or may be included onboard within the processor.

Controller 148 may be positioned in a variety of locations throughout oven appliance 100. In the illustrated embodiment, controller 148 may be located under or next to the user interface 128 otherwise within interface panel 132. In such an embodiment, input/output ("I/O") signals are routed between controller 148 and various operational components of oven appliance 100 such as valve 124, controls 134, display 130, temperature sensor 146, alarms, and/or other components as may be provided. In one embodiment, the user interface 128 may represent a general purpose I/O ("GPIO") device or functional block.

Although shown with touch type controls 134, it should be understood that controls 134 and the configuration of oven appliance 100 shown in FIG. 1 are provided by way of example only. More specifically, user interface 128 may include various input components, such as one or more of a variety of electrical, mechanical, or electro-mechanical input devices including rotary dials, push buttons, and touch pads. The user interface 128 may include other display components, such as a digital or analog display device designed to provide operational feedback to a user. The user interface 128 may be in communication with the controller via one or more signal lines or shared communication busses.

Also, oven 100 is shown as a wall oven, but the present invention could also be used with other cooking appliances such as, e.g., a stand-alone oven, an oven with a stove-top, or other configurations of such ovens.

Gas oven 100 is depicted with at least one valve 124 for controlling the flow of gas F to burner 126 and, therefore, the rate of heating H of cooking chamber 104. Valve 124 may be of a variety of different types including e.g., a proportional valve or a valve having predetermined set-points such as high-low, high-medium-low, or others. As previously indicated, valve 124 is in an electro-mechanical type that is communication with, and operated by, controller 148. More particularly, controller 148 can provide signals to determine the setting or position of valve 124 so as to determine the rate of gas flow F to gas burner 126. Controller 148 can e.g., send a signal that moves valve 124 between an off position (where no gas flow and, therefore, no heating from burner 126 is provided) to one or more other positions where a flow of gas F is provided to burner 126 so as to heat cooking chamber 104 at various rates of heating H depending upon the position of valve 124.

Figure 6:
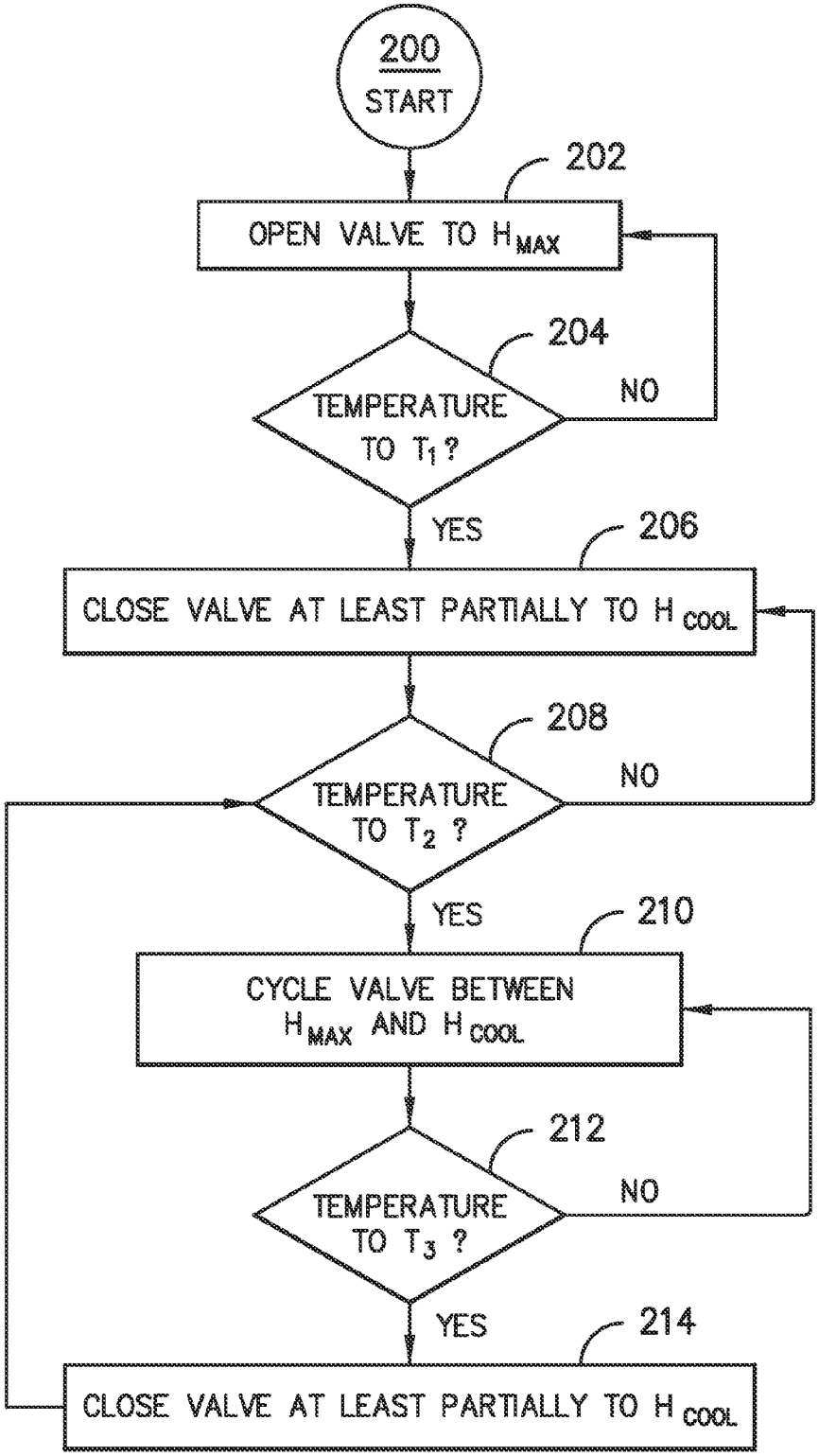
FIG. 6 is a flow chart representing an exemplary method of the present invention.
Figure 7:
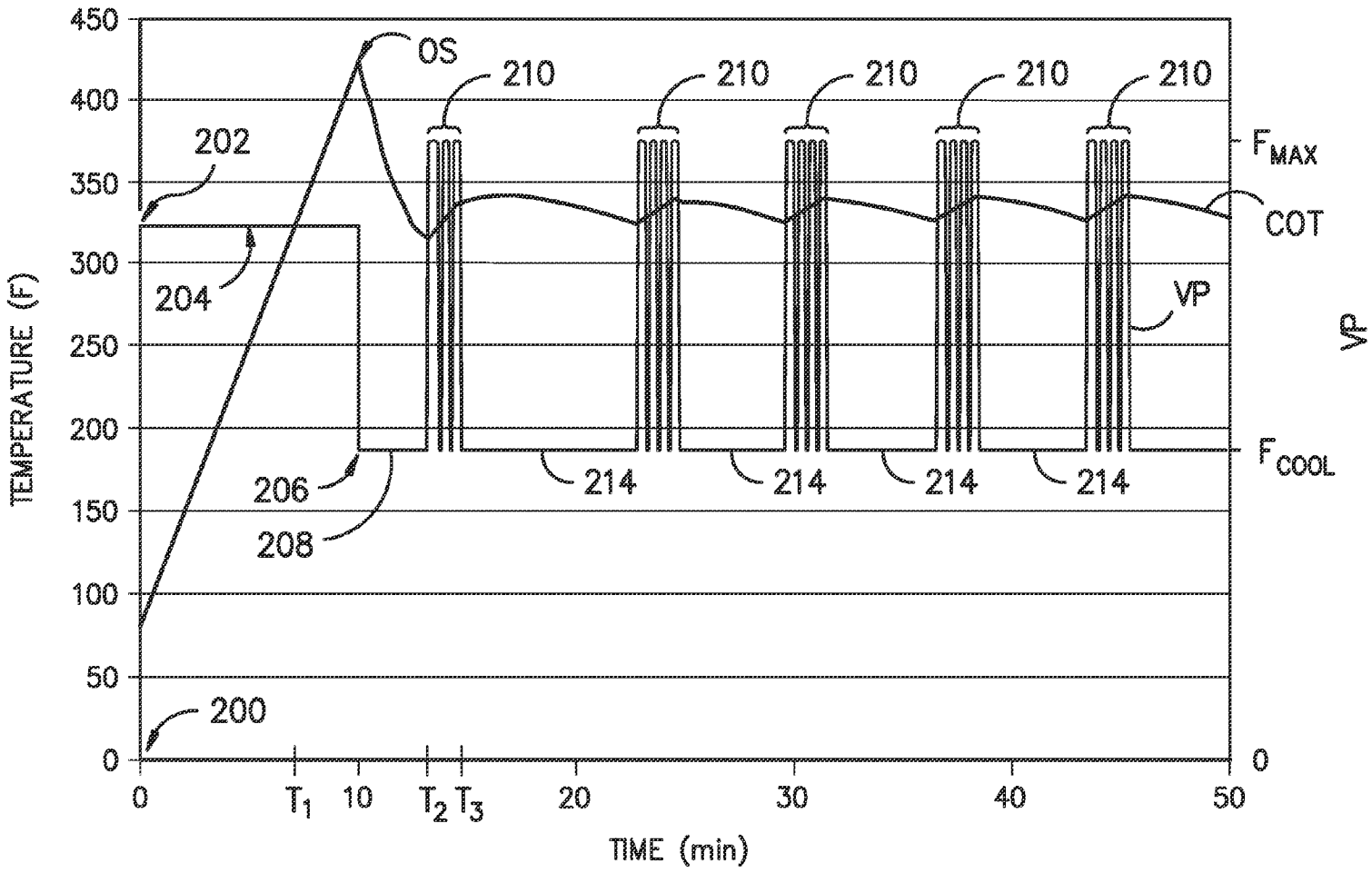
FIG. 7 is a plot illustrating steps of an exemplary method of the present invention and a resulting center of oven (COT) temperature.

FIG. 6 depicts an exemplary method of operating oven 100, and FIG. 7 is a plot of the COT (center of oven temperature) for gas oven 100 in response to the various steps of FIG. 7. VP, the corresponding position of valve 124, is also plotted. As previously indicated, controller 148 can be configured to operate oven 100 according to FIGS. 6 and 7. For this exemplary method, oven 100 has a maximum rate of heating represented herein as $H_{MAX}$. The maximum rate of heating, or $H_{MAX}$, represents the maximum heating rate of cooking chamber 104 that is provided by gas burner 126 during operation of oven 100. For example, $H_{MAX}$ may be initiated by controller 148 causing valve 124 to completely open so as to provide the maximum rate of gas flow $F_{MAX}$ possible through valve 124.

During preheating of oven 100, for convenience of the user it is desirable to heat cooking chamber 104 from e.g., ambient temperature to a user-selected set-point temperature T1 as quickly as possible. For example, set-point temperature T1 may be the temperature selected by the user for cooking operations. In FIG. 7, a set-point temperature T1 of 350 degrees Fahrenheit (350° F.) is used by way of example. Accordingly, from start 200, valve 124 is opened to provide a maximum rate of gas flow $F_{MAX}$ to preheat cooking chamber 104 at the maximum rate of heating, $H_{MAX}$, as indicated by step 202.

In step 204, controller 148 monitors the temperature in the cooking chamber 104 and maintains the maximum rate of heating, $H_{MAX}$, until at least set-point temperature T1 is obtained in cooking chamber 104. For this example, the $H_{MAX}$ is obtained by having valve 124 in a wide open position corresponding to a gas flow rate $F_{MAX}$.

Once set-point temperature T1 is obtained in cooking chamber 104, valve 124 is at least partially closed in step 206 so as to reduce gas flow $F_{MAX}$ through valve 124 to a lower gas flow rate $F_{COOL}$. This lower gas flow rate $F_{COOL}$ provides a rate of heating, $H_{COOL}$, that is less than $H_{MAX}$. $H_{COOL}$ is also at a rate that allows cooking chamber 104 to begin cooling from the overshoot on temperature (OS in FIG. 7) that will occur as part of the rapid preheating step 204. In one exemplary embodiment, $H_{COOL}$ is such that the temperature of the cooking chamber decreases at a rate of about 2° F. per minute to about 6° F. per minute. In still another embodiment, $H_{COOL}$ is such that the temperature of the cooking chamber decreases at a rate of about 4° F. per minute. In another embodiment, valve 124 could also be completely closed in step 206 such that $F_{COOL}$ is zero.

In step 208, valve 124 is maintained in a condition that provides a rate of heating $H_{COOL}$ until the temperature in cooking chamber 104 decreases to a second temperature T2, where temperature T2 is less than temperature T1. In one exemplary embodiment of the invention, temperature T2 is at least about 15° F. less than temperature T1. In another exemplary embodiment of the invention, temperature T2 is at least about 10° F. less than temperature T1. In still another exemplary embodiment of the invention, temperature T2 is at least about 5° F. less than temperature T1.

Once the cooking chamber 104 cools to temperature T2, in step 210 controller 148 cycles valve 124 between the higher gas flow rate setting, $F_{MAX}$, and the lower gas flow rate setting, $F_{COOL}$. More particularly, in step 210 the controller 148 changes the position of valve 124 so as to rapidly alternate the rate of heating of cooking chamber 104 by burner 126 between $H_{MAX}$ and $H_{COOL}$. Such cycling is performed at a frequency that provides an overall rate of heating, $H_{CK}$, of cooking chamber 104 that is between $H_{MAX}$ and $H_{COOL}$. As such, the COT in cooking chamber 104 increases but at a rate that is less than the rate during e.g., preheating when valve 124 provides a flow $F_{MAX}$ resulting in a continuous rate of heating at $H_{MAX}$. In one exemplary embodiment of the invention, the rate of cycling of valve 124 provides a rate of heating, $H_{CK}$, of cooking chamber 104 that is between about 5° F. per minute to about 10° F. per minute. In another exemplary embodiment of the invention, the rate of cycling of valve 124 provides a rate of heating, $H_{CK}$, of cooking chamber 104 that is between about 7° F. per minute to about 9° F. per minute. In another exemplary embodiment, the rate of cycling of valve 124 provides a rate of heating, $H_{CK}$, of cooking chamber 104 that is about 8° F. per minute. In still another exemplary embodiment, $H_{CK}$ is about 75 percent or less of $H_{MAX}$.

During the cycling step 210, the temperature in cooking chamber 104 will increase as shown in FIG. 7. Controller 148 monitors the temperature using e.g., temperature sensor 124 as shown in step 212. Upon increasing to at least a temperature of T3 that is greater than temperature T2, in step 214 controller 148 again closes or partially shuts valve 124 to provide a lower gas flow rate F and, consequentially, a lower rate of heating H that is less than $H_{MAX}$. For example, controller 148 could position valve 124 to provide a gas flow rate $F_{COOL}$ for a lower rate of heating $H_{COOL}$. Controller 148 maintains valve 124 at flow rate $F_{COOL}$ until the temperature again decreases to T2.

Once the temperature decreases to T2, controller 148 then repeats steps 208, 210, 212, and 214. Stated alternatively, controller 148 continues to measure the temperature in cooking chamber 104 and, upon decreasing to at least T2, controller 148 again cycles valve 124 to alternate rapidly between a high rate of heating and lower rate of heating (e.g., $H_{MAX}$ and $H_{COOL}$) to provide the overall rate of heating $H_{CK}$ of cooking chamber 104. Once at least a temperature of T3 is obtained, controller 148 at least partially shuts valve 124 to provide a lower rate of heating H that is less than $H_{MAX}$ (e.g., $H_{COOL}$). As shown in FIG. 7, steps 208, 210, 212, and 214 (which include cycling and partially shutting valve 124) are sequenced so as to maintain the oven temperature as close as possible to T1 (the desired set-point temperature that is e.g., selected by the user) over a time period determined to be sufficient for cooking the food. In one exemplary aspect of the present invention, temperature T3 is within about 10° F. of set-point temperature T1. In another exemplary aspect, temperature T3 is within about 5° F. of set-point temperature T1. In still another exemplary aspect, temperature T3 is about equal to set-point temperature T1.

Figure 2:
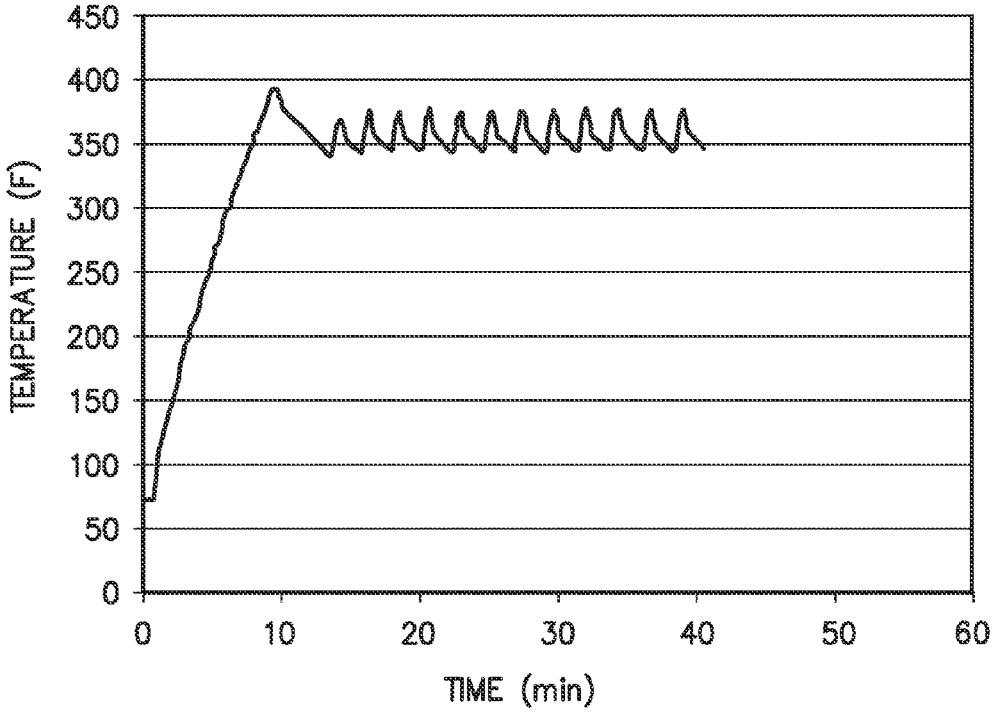
FIG. 2 is a plot of temperature over time for the operation of a conventional gas oven including the time for preheating.
Figure 3:
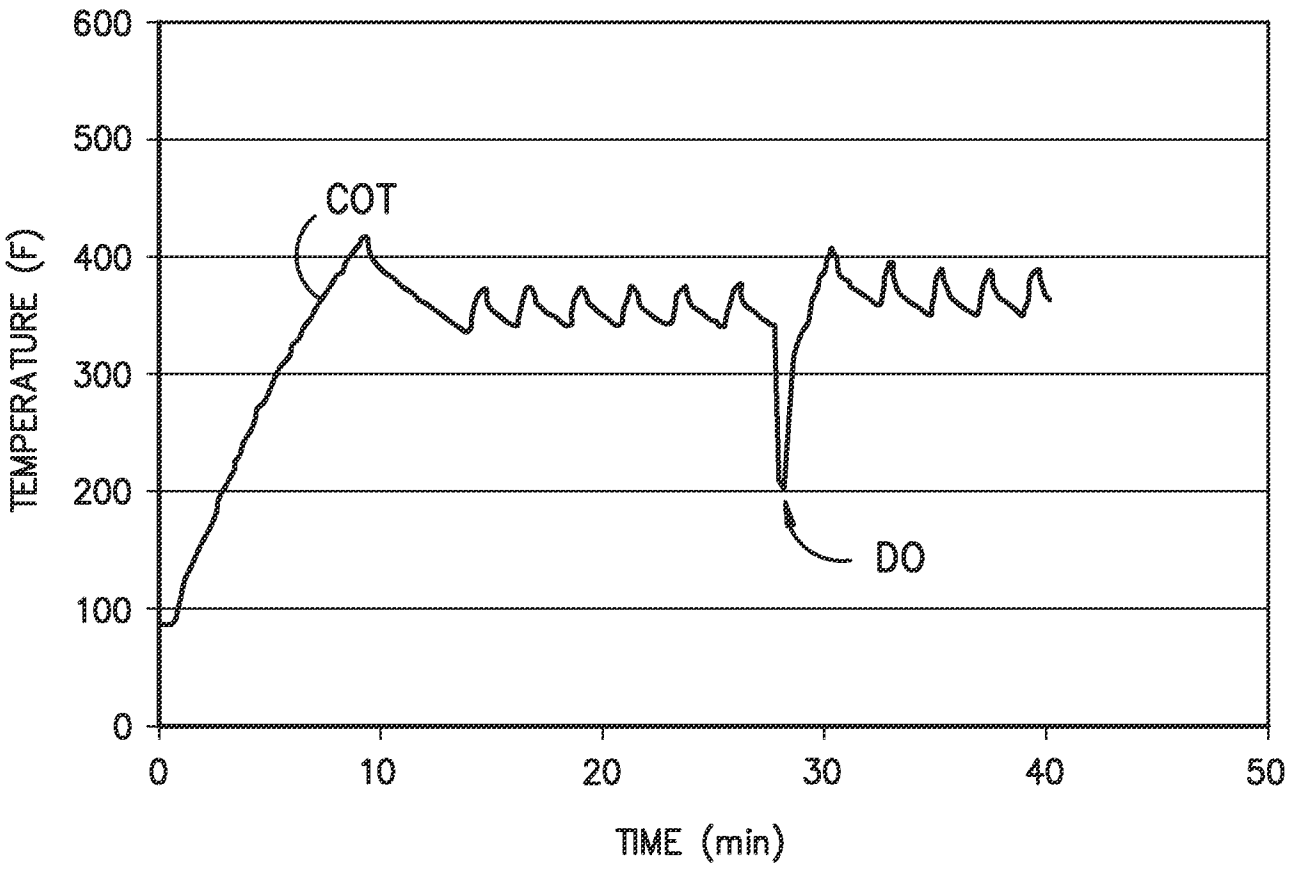
FIG. 3 is a plot of temperatures over time for a conventional gas oven including the time for preheating, and an event where the oven door is opened.

A comparison of the COT in FIG. 7 with the COT of FIG. 2 illustrates certain advantages of the exemplary method of the present invention (FIG. 7) over conventional operation (FIG. 2). For example, after preheating, the period of cycling valve 124 in order to maintain the set-point temperature T1 is longer, which means that during cooking operations the food is exposed less to the higher heating rate associated with conventional a gas burner operation. Additionally, the heating rate between temperature T2 and set-point temperature T1 during cooking operations is much less, which means again that the food is exposed less to the higher heating rate associated with a conventional gas burner operation. Finally, because of the rapid cycling of valve 124, more uniform heating of cooking chamber 104 is achieved due to the more turbulent convective heat flows created by the rapid cycling. This results in more uniform cooking of food placed into the oven.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A method of operating a gas oven appliance having a cooking chamber, the gas oven appliance having a maximum rate of heating, HMAX, the method comprising the steps of:

opening a valve to preheat the cooking chamber at the maximum rate of heating, HMAX, until at least a temperature T1 is obtained in the cooking chamber, wherein temperature T1 is a set-point temperature selected by the user of the appliance;

closing the valve partially or completely until the temperature in the cooking chamber decreases to at least a temperature T2 that is less than temperature T1;

cycling the valve between a higher gas flow rate setting and a lower gas flow rate setting or an off setting so as to heat the cooking chamber at a rate of heating HCK that is less than the maximum rate of heating HMAX, the step of cycling continuing until the temperature of the cooking chamber increases to at least a temperature T3 that is greater than temperature T2; and shutting the valve partially or completely so as to provide a lower rate of heating that is less than HMAX while the cooking chamber decreases to at least the temperature T2.

2. The method of operating a gas oven appliance having a cooking chamber as in claim 1, wherein said step of closing the valve comprises partially closing the valve so as to provide a rate of heating, HCOOL, of the cooking chamber that is less than the maximum rate of heating, HMAX.

3. The method of operating a gas oven appliance having a cooking chamber as in claim 1, wherein once the temperature decreases to at least the temperature T2 during the step of shutting the valve, the method further comprises the steps of:

repeating the steps of cycling and maintaining for a time period determined to cook food placed into the cooking chamber.

4. The method of operating a gas oven appliance having a cooking chamber as in claim 1, wherein temperature T3 is about equal to temperature T1.

5. The method of operating a gas oven appliance having a cooking chamber as in claim 1, wherein temperature T3 is within about 10 degrees Fahrenheit of temperature T1.

6. The method of operating a gas oven appliance having a cooking chamber as in claim 1, wherein temperature T3 is within about 5 degrees Fahrenheit of temperature T1.

7. The method of operating a gas oven appliance having a cooking chamber as in claim 1, wherein temperature T2 is at least about 15 degrees Fahrenheit less than temperature T1.

8. The method of operating a gas oven appliance having a cooking chamber as in claim 1, wherein temperature T2 is at least about 10 degrees Fahrenheit less than temperature T1.

9. The method of operating a gas oven appliance having a cooking chamber as in claim 1, wherein the rate of heating HCK is about 5 degrees Fahrenheit per minute to about 10 degrees Fahrenheit per minute.

10. The method of operating a gas oven appliance having a cooking chamber as in claim 9, wherein the rate of heating HCK is about 7 degrees Fahrenheit per minute to about 9 degrees Fahrenheit per minute.

11. The method of operating a gas oven appliance having a cooking chamber as in claim 9, wherein the rate of heating HCK is about 8 degrees Fahrenheit per minute.

12. The method of operating a gas oven appliance having a cooking chamber as in claim 1, wherein the valve is a proportional valve.

13. The method of operating a gas oven appliance having a cooking chamber as in claim 1, wherein the higher gas flow rate setting of the step of cycling provides the maximum rate of heating, HMAX of the cooking chamber.

14. The method of operating a gas oven appliance having a cooking chamber as claim 1, wherein the rate of heating HCK is about 75 percent or less of the maximum rate of heating, HMAX.

15. The method of operating a gas oven appliance having a cooking chamber as is in claim 1, wherein after the step of closing the valve, the cooking chamber decreases to the temperature T2 at a rate of about 2 degrees Fahrenheit per minute to about 6 degrees Fahrenheit per minute.

16. The method of operating a gas oven appliance having a cooking chamber as in claim 15, wherein after the step of closing the valve, the cooking chamber decreases to the temperature T2 at a rate of about 4 degrees Fahrenheit per minute.

17. The method of operating a gas oven appliance having a cooking chamber as in claim 1, wherein during the step of shutting the valve partially the cooking chamber is provided with a rate of heating, HCOOL.

18. An oven appliance, comprising:

a cooking chamber for the receipt of food for cooking;

a gas burner for combustion of a gaseous fuel to heat the cooking chamber;

a valve controlling a flow of gaseous fuel to the gas burner;

a temperature sensor for measuring the temperature of the cooking chamber;

a controller in communication with the valve and the temperature sensor, the controller configured for opening the valve to preheat the cooking chamber at a maximum rate of heating, HMAX, at least until a temperature T1 is obtained in the cooking chamber, wherein temperature T1 is a set-point temperature selected by the user of the appliance;

closing the valve partially to provide a rate of heating, HCOOL, of the cooking chamber that is less than the maximum rate of heating, HMAX, with the valve remaining partially closed until the temperature in the cooking chamber decreases to a temperature T2 that is less than temperature T1;

cycling the valve between a higher gas flow rate setting and a lower gas flow rate setting so as to heat the cooking chamber at a rate of heating HCK that is less than the maximum rate of heating HMAX, continuing the step of cycling until the temperature of the cooking chamber increases to at least a temperature T3 that is greater than temperature T2;

shutting the valve partially to provide a lower rate of heating that is less than HMAX while the cooking chamber decreases to at least the temperature T2; and repeating the steps of cycling, continuing, and shutting for a period of time sufficient for cooking.

19. A method of operating a gas oven appliance having a cooking chamber, the gas oven appliance having a maximum rate of heating, HMAX, the method comprising the steps of:

opening a valve to preheat the cooking chamber until at least a temperature T1 is obtained in the cooking chamber, wherein temperature T1 is a selectable set-point temperature;

closing the valve partially or completely until the temperature in the cooking chamber decreases to at least a temperature T2 that is less than temperature T1;

cycling the valve between a higher gas flow rate setting and a lower gas flow rate setting or an offsetting so as to heat the cooking chamber at a rate of heating HCK that is less than the maximum rate of heating HMAX, the step of cycling continuing until the temperature of the cooking chamber increases to at least a temperature T3 that is greater than temperature T2; and shutting the valve partially or completely so as to provide a lower rate of heating that is less than HMAX while the cooking chamber decreases to at least the temperature T2.

20. The method of operating a gas oven appliance having a cooking chamber as in claim 19, wherein cycling the valve occurs rapidly such that the rate of heating HCK of the cooking chamber is between about 5 degrees Fahrenheit per minute to about 10 degrees Fahrenheit per minute.

* * * * *